US011338469B2

(12) United States Patent
Potvin

(10) Patent No.: US 11,338,469 B2
(45) Date of Patent: May 24, 2022

(54) INTERCHANGEABLE DEBARKING RINGS APPARATUS AND METHOD

(71) Applicant: BID GROUP TECHNOLOGIES LTD., Mirabel (CA)

(72) Inventor: Simon Potvin, Saint-Georges (CA)

(73) Assignee: BID GROUP TECHNOLOGIES LTD., Mirabel (CA)

( * ) Notice: Subject to any disclaimer, the term of this patent is extended or adjusted under 35 U.S.C. 154(b) by 4 days.

(21) Appl. No.: 16/865,965

(22) Filed: May 4, 2020

(65) Prior Publication Data

US 2020/0346363 A1 Nov. 5, 2020

Related U.S. Application Data

(60) Provisional application No. 62/842,240, filed on May 2, 2019.

(51) Int. Cl.
*B27L 1/08* (2006.01)

(52) U.S. Cl.
CPC ..... *B27L 1/08* (2013.01)

(58) Field of Classification Search
CPC ..... B27L 1/00; B27L 1/04; B27L 1/08; B27L 1/10
See application file for complete search history.

(56) References Cited

U.S. PATENT DOCUMENTS

| | | | | |
|---|---|---|---|---|
| 2,843,168 | A * | 7/1958 | Lunn | B27L 1/08 144/208.8 |
| 3,913,644 | A * | 10/1975 | Braun | B27L 1/10 144/208.8 |
| 5,704,409 | A * | 1/1998 | Brisson | B23Q 11/0032 144/208.1 |
| 6,991,011 | B2 * | 1/2006 | Huhtasalo | B27L 1/05 144/208.1 |
| 7,841,373 | B2 * | 11/2010 | Rastatter | B27L 5/04 144/209.1 |
| 8,256,476 | B2 | 9/2012 | Cholewczynski et al. | |
| 9,073,233 | B2 | 7/2015 | Cholewczynski | |
| 9,469,046 | B2 | 10/2016 | Cholewczynski et al. | |
| 10,406,720 | B2 * | 9/2019 | Rooney | B27L 11/02 |
| 2003/0226617 | A1 * | 12/2003 | Choquette | B27L 1/00 144/4 |
| 2011/0226385 | A1 * | 9/2011 | Mitchell | B27B 31/04 144/335 |

* cited by examiner

*Primary Examiner* — Matthew Katcoff
(74) *Attorney, Agent, or Firm* — Brouillette Legal Inc.; Robert Brouillette

(57) ABSTRACT

The present invention is a debarking ring apparatus to prevent operational downtime of logs debarking by having two debarking rings placed on the same vertical plan, perpendicular to the flow of incoming and outgoing logs, and parallel to each other. Only one ring may be operational at a time. As such, maintenance may be done on one of the rings while the other is in operation. Debarking rings may have varying sizes and shapes independent from each other. Each debarking ring may further have its own frame, actuator and control and motorization modules. A sliding system, supported by a frame, may further direct the lateral displacement of both rings. Also presented is a method of processing logs through the debarking ring apparatus.

16 Claims, 4 Drawing Sheets

INTERCHANGEABLE DEBARKING RINGS APPARATUS AND METHOD

CROSS-REFERENCE TO RELATED APPLICATIONS

The present patent application claims the benefits of priority of U.S. Provisional Patent Application No. 62/842,240, entitled "INTERCHANGEABLE DEBARKING RINGS APPARATUS" and filed at the United-States Patent and Trademark Office on May 2, 2019.

FIELD OF THE INVENTION

The present invention generally relates to apparatuses, systems and methods for debarking logs. More particularly, the present invention relates to an interchangeable debarking rings apparatus configured to interchange two different debarking rings about a single plan.

BACKGROUND OF THE INVENTION

Debarking, or the process of removing bark from wood, has been around for many years. In the industrial world, the debarking process requires the use of heavy machinery called debarker or debarking apparatus. Debarkers typically comprise rings adapted to allow logs passing within said rings. A ring generally comprises a cutting mechanism positioned on or protruding from an inner face of the ring to remove bark. Conventionally, debarking apparatuses and systems only comprise a single debarking ring. When a tool arm, a tip or any other part of the debarking ring breaks, such debarking ring must be repaired. To repair or provide maintenance, the production line must be stopped during such operations.

Other systems comprise two debarking rings, a first ring being operated in a clockwise direction and a second ring being operated in a counter clockwise direction in order to achieve higher operational speed. Such systems generally require that both debarking rings have the same inner diameter. The debarking rings of such systems are serially positioned in the production line, thus occupying more space in the production line.

On such production lines, only logs having a diameter equal or lower than the diameter of the smallest debarking ring may be processed. When processing logs with diameters larger than the diameter of the debarking ring, a debarking ring having a larger diameter must be bought and/or installed on the production line. Acquiring new rings is financially expensive and requires time and resources. As improved operational speeds and reduced downtimes are top priorities for modern sawmills, it is believed that there is a need for an apparatus allowing the process of logs of differing diameters. Furthermore, replacing a debarking ring may somehow increase the risk of malfunctions of the machinery, especially when the replacement process in done in a hurry to minimize the downtime impact on the production line.

Therefore, there is a need for a debarking apparatus adapted to improve productivity of a production line by minimizing or avoiding downtimes of the said production line. Also, there is a need for an apparatus for improving flexibility of debarking rings to allow processing logs having a diameter varying in time without performance drops.

SUMMARY OF THE INVENTION

The shortcomings of the prior art are generally mitigated by providing an interchangeable debarking rings apparatus.

The apparatus of the present invention may prevent downtime by switching one debarking ring for another. Instead of using two debarking rings on a different perpendicular plan as a function of the flow, the present apparatus may uses two debarking rings slidably mounted in a single plan being generally perpendicular to the flow of the logs. In some embodiments, the aperture adapted to receive a log or stem of each debarking ring may have a different diameter.

The apparatus of the present invention may further prevent operational downtime by having two debarking rings. Only one ring may be operational at a time. As such, maintenance may be done on one of the rings while the other is in operation. Furthermore, both debarking rings may be positioned on the same vertical plan, perpendicular to the flow of incoming and outgoing logs, and parallel to each other. Debarking rings may have varying sizes and shapes independent from each other.

In another aspect of the invention, each debarking ring may have its own frame, actuator and control and motorization modules. A sliding system, such as a shaft, supported by a common frame, may further direct the lateral displacement of both rings.

In another aspect of the invention, a method for debarking logs is a provided. The method comprises the steps of receiving a log through an infeed module; moving, if not already in place, and positioning a functional debarking ring capable of processing the diameter of the log in line with the output of the infeed module; adjusting the position, angle and movement of the log with the infeed module based on the position of the receiving debarking ring; debarking the log passing through the aperture of the functional debarking ring; and adjusting the position of the outfeed module so that it receives the log from the output of the debarking ring and moving with the outfeed module until the log exits the outfeed module.

In another aspect of the invention, a log debarking apparatus comprising a frame and a first and second debarking rings, each of the debarking rings comprising a frame and an aperture adapted to receive and debark the diameter of the log. The first and second debarking rings being moveably mounted to the frame of the apparatus on a plan substantially perpendicular to a flow of the log to be debarked.

Any one of the first and second debarking rings may be moveable in an operational mode and may be both moveable in a non-operational mode. Each of the first and second debarking rings may be slidably mounted to the frame of the apparatus.

The debarking apparatus may comprise an infeed module and an outfeed module.

The debarking apparatus may comprise a displacement system, the frames of each of the first and second debarking rings being mounted to the displacement system. the displacement system may further comprise a first displacement mechanism independently moving the first debarking ring and a second displacement mechanism independently moving the second debarking ring. The displacement system may comprise sensing elements configured to determine the location of each debarking ring in relation to the frame of the apparatus. The sensing element may be connected to a controller, the controller being configured to control movement of the displacement system. The displacement system may comprise a motorization module, the controller being in communication with the motorization module.

The aperture of the first debarking ring may having a first maximum opening diameter, the aperture of the second debarking ring may have a second maximum opening diameter which is different than the first maximum opening diameter. The debarking ring apparatus may be in working communication with at least another apparatus in a line assembly.

In yet another aspect of the invention, a log debarking apparatus is provided. The apparatus comprises a frame, an infeed module adapted to receive a flow of logs, an outfeed module, a first and second debarking rings moveable in a plan substantially perpendicular to the flow of logs and a displacement system adapted to move any one of the first and second debarking rings in an operative mode and any one or both of the first and second debarking rings in a non-operative mode.

In a further aspect of the invention, a method for debarking logs is provided, the method comprises receiving a flow of logs to be debarked through a first debarking ring comprising an aperture having a first maximum diameter and moving the first debarking ring in a non operative position along a plan substantially perpendicular to the flow of logs.

The method may further comprise moving a second debarking ring in an operative position along the plan substantially perpendicular to the flow of logs and receiving the flow of logs to be debarked through the second debarking ring. The method may comprise moving the second debarking ring in the non-operative mode while the first debarking ring is in the non-operative mode. The reception of the flow of logs to be debarked through the first debarking ring may further comprise receiving the logs through a first aperture of the first debarking ring having a first maximum diameter and reception of the flow of logs to be debarked through the second debarking ring further comprising receiving the logs through a second aperture of the second debarking ring having a second maximum diameter being different than the first maximum diameter.

The method may further comprise detecting a diameter of the log to be debarked, determining which of the first and second debarking rings comprise the aperture having a diameter adapted to receive the detected diameter and, if the determined debarking ring is in the non-operative mode, moving the debarking ring in the operative mode to the non-operative mode and moving the determined debarking ring in the operative mode.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE INVENTION

A novel interchangeable debarking rings apparatus will be described hereinafter. Although the invention is described in terms of specific illustrative embodiment(s), it is to be understood that the embodiment(s) described herein are by way of example only and that the scope of the invention is not intended to be limited thereby.

Figure 1:
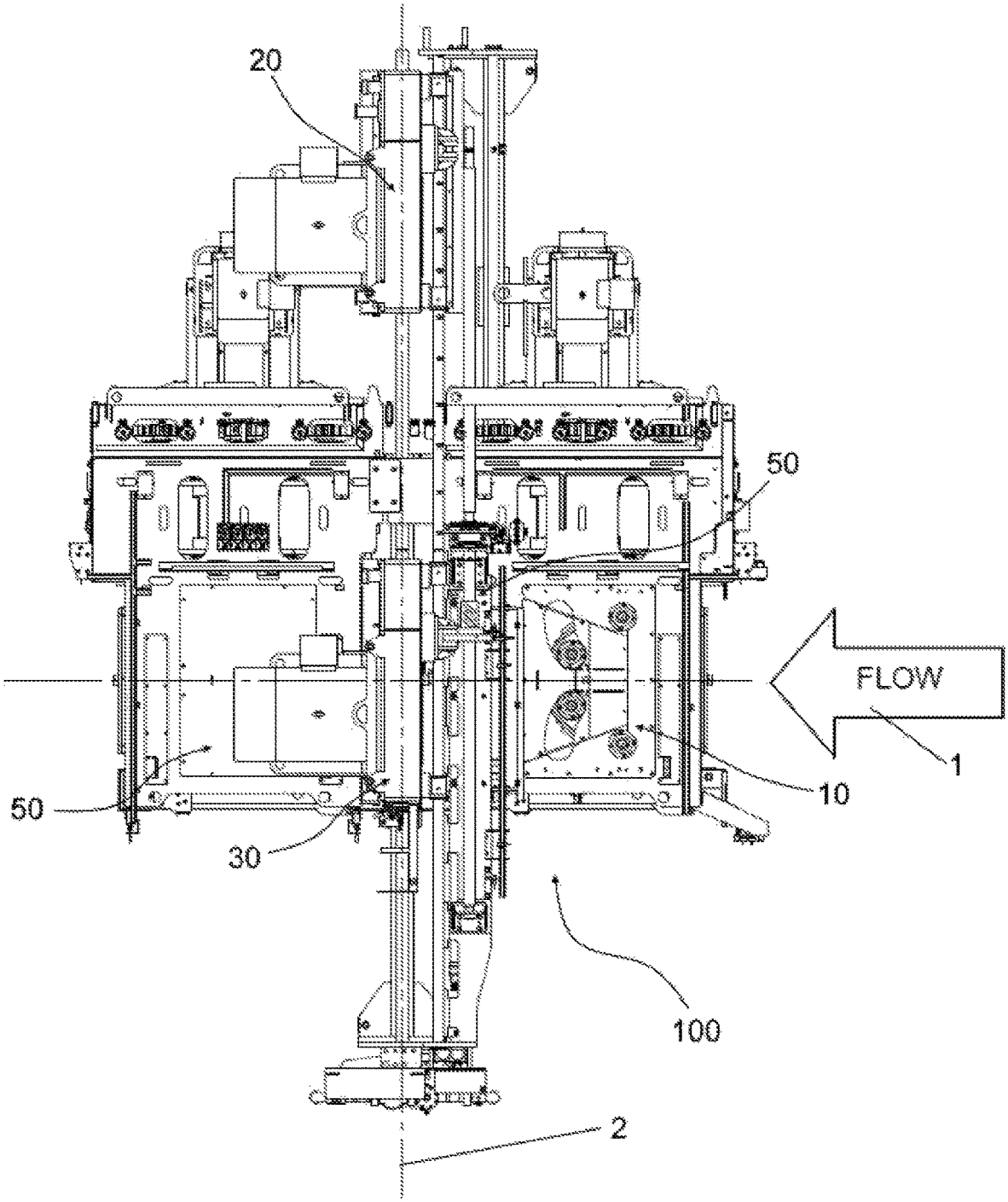
FIG. 1 is a top view of an embodiment of an interchangeable debarking rings apparatus in accordance with the principles of the present invention.

Referring first to FIG. 1, an embodiment of an interchangeable debarking rings apparatus 100 is illustrated. The debarking apparatus 100 comprises an infeed module 10, a first moveable debarking ring 20 and a second moveable debarking ring 30, a ring displacement system 40 and an outfeed module 50.

Broadly, a log or stem enters the infeed module 10 and passes through one of the moveable debarking rings 20 or 30 in operation mode. The displacement system 40 moves the rings 20 or 30 accordingly. The moveable ring 20 or 30 removes the bark from the log. The barkless log is then moved to the outfeed module 50 before exiting the apparatus 100. As shown in FIG. 1, the direction of the flow of logs is illustrated by the arrow 1.

As discussed above, the log or stem typically enters the debarking apparatus 100 through the infeed module 10. Understandably, any infeed module 10 known in the art for debarking a log or stem may be used. The infeed module 10 may have any shape and/or size adapted to logs being debarked. Also, any type of conveying mechanism (not shown) known in the art may be used to move the logs.

In the exemplary embodiment shown in FIG. 1, the infeed module 10 comprises log displacement system (not shown), such as rolls, conveyors or a combination of idling and drive wheels, adapted to receive the shape of a log. Broadly, the infeed module 10 aims at moving one end of the log to the other end of the log. The infeed module 10 may further be adapted to position and/or prepare a log before entering in a debarking ring. In some embodiments, the infeed module 10 may comprise sensors detecting the presence of a log when entering the infeed module 10 and/or sensors detecting a log exiting the infeed module 10. In such embodiments, the sensors may be in communication with a controller, an automaton or an industrial robot, such as a programmable logic controller (PLC). The controller is further configured to control activation and deactivation of the log displacement system.

After being processed and/or aligned by the infeed module 10, the log is moved in the debarking ring 20 or 30 aligned or positioned with the flow direction 1.

In some embodiments, the infeed module 10 and the outfeed module 50 are positioned such that a log may be supported or processed by the infeed module 10 while another part of the log is supported or processed by the outfeed module 50. The outfeed module 50 may further comprise one or more log displacement system 52, such as rolls, combination of idling and drive wheels or conveyors, adapted to receive the log and to move the said log. Understandably, the infeed module 10 and the outfeed module 50 may be controlled separately or may be synchronized using any know method in the art.

Referring now to FIGS. 1 to 4, the debarking rings 20 and 30 of the apparatus 100 are illustrated. The debarking ring 20 will next be described. Understandably, the debarking ring 30 may be embodied exactly as the debarking ring 20 or may be embodied differently. The exemplary debarking ring 20 comprises a frame 21 adapted to be slidably or movingly mounted on the apparatus 100. In other embodiments, the frame 21 or another portion of the debarking ring 20 may be attached to the ring displacement system 40. Each frame 21 or 31 may be independent from one of another. The frame 21 or 31 of each debarking ring 20 or 30 is generally used as a housing. In such embodiments, the frame 21 or 31, partially or entirely covers the debarking ring 20 or 30 and/or provides structural support to the debarking ring 20 or 30. Understandably, the frame 21 or 31 may have different sizes and shapes.

The debarking ring 20 further comprises radial arms 22 pivotally mounted to the frame 21. In some embodiments, the radial arms 22 are mounted through a pivoting mechanism 23. The radial arms 22 are generally embodied as curved arms. The radial arms 22, as they pivot, form a retractable and expendable aperture 24. Debarking tools, or any other type of tool for removing bark from the log, may be mounted at the central extremity of the arms 22 to remove bark from the log passing through the aperture. Thus, the size of the aperture 24 varies with movement of the arms and adapt to the diameter of a passing log. Understandably, any other debarking ring know in the art or to be developed may be used on the present apparatus within the scope of the present invention.

Still referring to FIGS. 1 to 4, the embodied apparatus 100 comprises a first 20 and a second debarking rings 30. In such an embodiment, the rings 20 and 30 are moveably mounted on the apparatus 100 on a plane 2. The plane 2 is generally between the infeed 10 and outfeed module 50. In such an embodiment, one of the two rings 20 or 30 may be positioned in an operational mode, thus between the infeed 10 and outfeed module 50.

The apparatus 100 further comprises a ring displacement system 40. The ring displacement system 40 broadly allows each debarking ring 20 or 30 to move laterally about the apparatus 100. In the illustrated embodiment, the ring displacement system 40 comprises a track mechanism or a shaft 41 mounted to the frame 60 of the apparatus 100. Typically, the shaft 41 is mounted at each extremity 61 and 62 of the frame 60 or of the apparatus 100. Understandably, the shaft 41 may have a variable length, as required for the movement of the debarking rings 20 and 30. The debarking rings 20 and 30 are moveably mounted to the shaft 41. In the illustrated embodiments, the debarking ring 20 comprises brackets 25 adapted to support the ring 20 on the shaft 41. In some embodiments, the shaft 41 may be of rigid material, such as steel. The shaft 41 may further be coated with frictionless material or substance, such as chrome, frictionless paint, oil or grease. In yet other embodiments, the track mechanism 41 may be embodied as a system of rails, a slide system, a conveyor or any other guiding system. Understandably, the track mechanism or shaft 41 may have any sectional shape allowing guiding the debarking rings 20 or 30, such as but not limited to round, square, triangle, etc.

Figure 2:
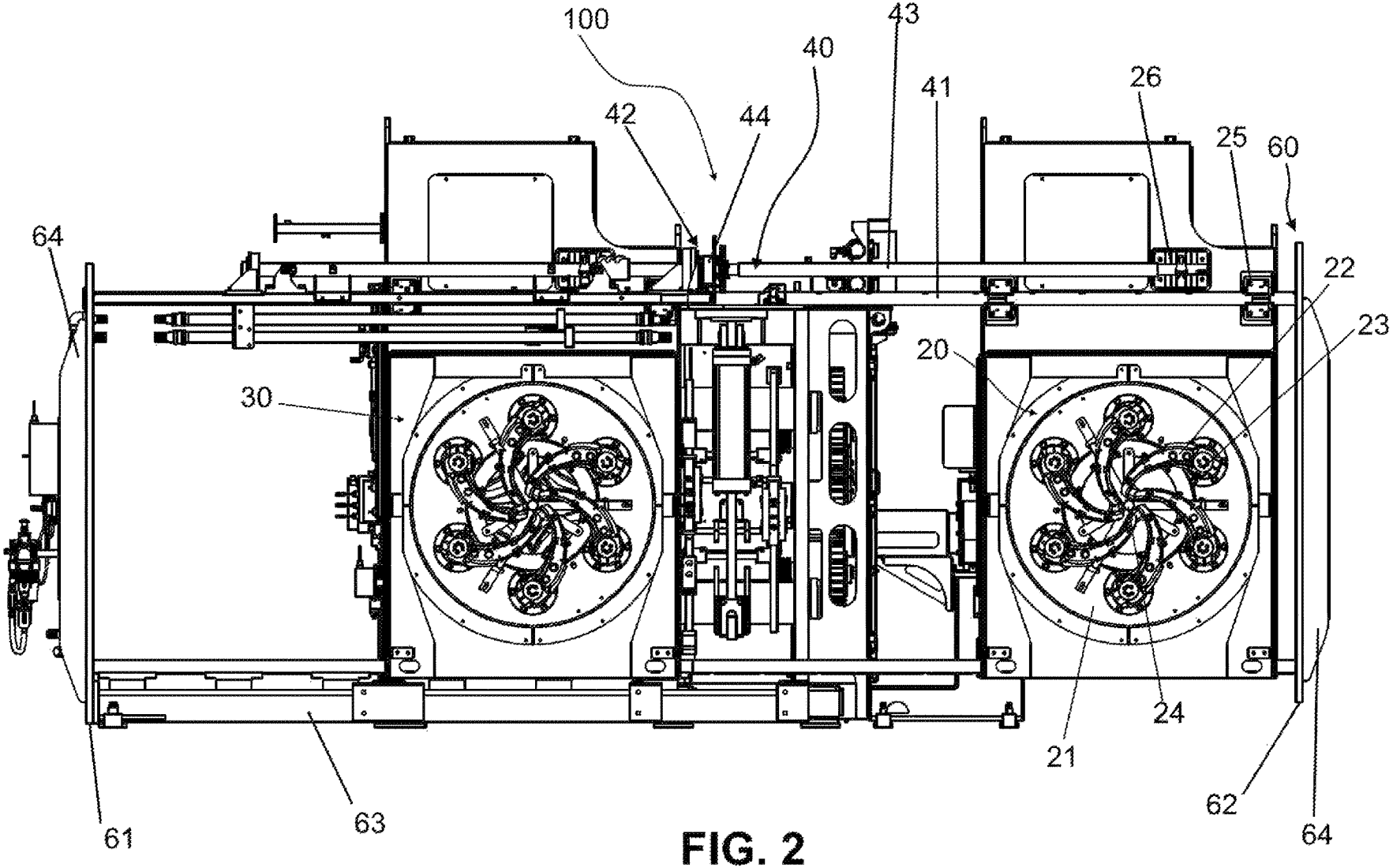
FIG. 2 is a sectional front view of the apparatus of FIG. 1 shown with a first debarking ring in operation mode and a second debarking ring in maintenance mode.
Figure 3:
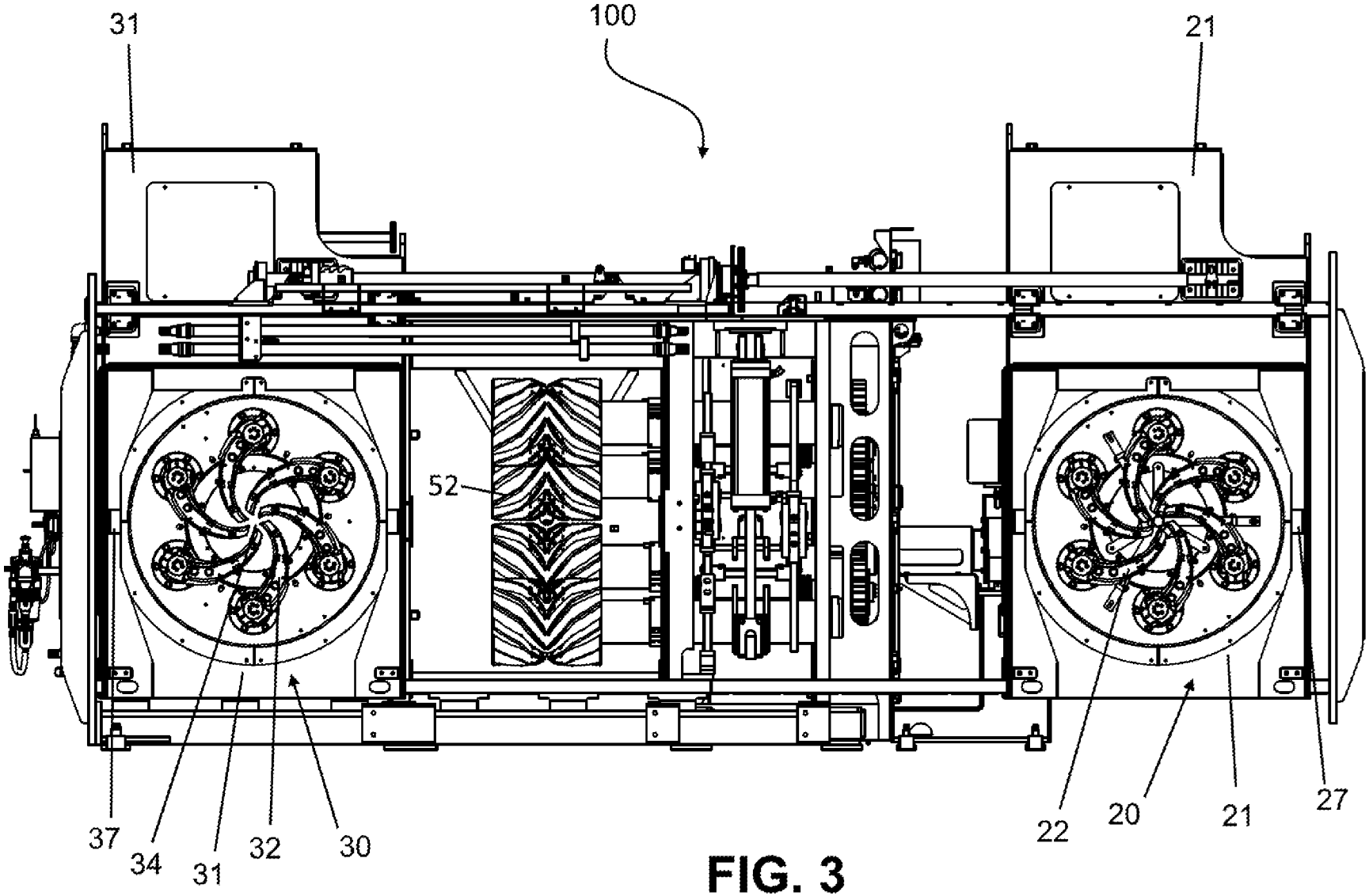
FIG. 3 is a sectional front view of the apparatus of FIG. 1 shown with a first and a second debarking rings in maintenance mode.
Figure 4:
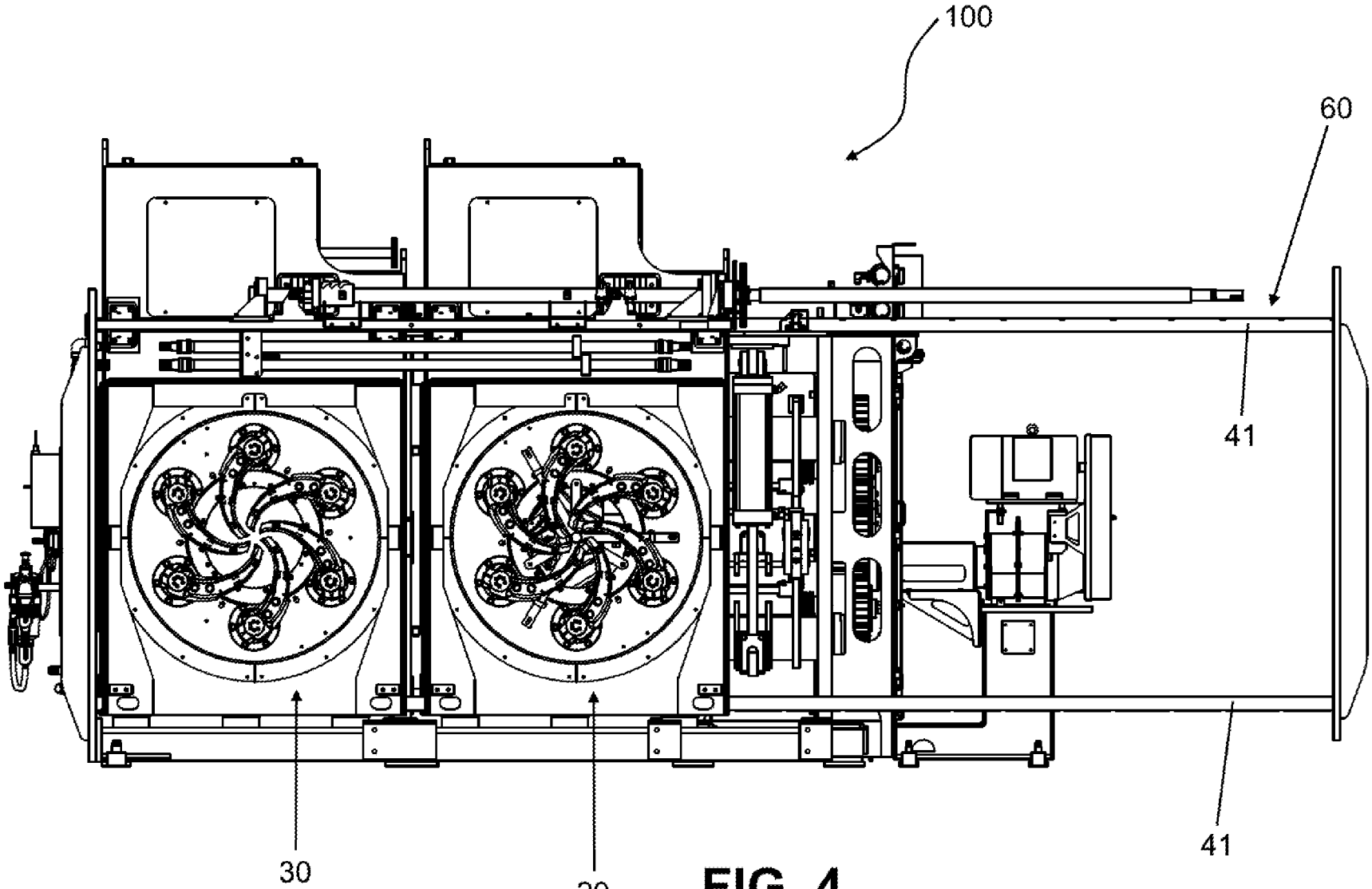
FIG. 4 is a sectional front view of the apparatus of FIG. 1 shown with a first debarking ring in maintenance mode and a second debarking ring in operation mode.

Referring now to FIGS. 2 to 4, the ring displacement system 40 may further comprise a displacement mechanism 42. In the illustrated embodiment, each debarking ring 20 or 30 is connected to a displacement mechanism 42, allowing asynchronous or independent movement of each debarking ring 20 or 30. Understandably, in other embodiments, a single displacement mechanism 42 may allow synchronous movement of both debarking rings 20 or 30.

In such an embodiment, the displacement mechanism 42 comprises a rod or shaft 43 attached or mounted to one of the debarking rings 20 or 30. In the exemplary embodiment, the rod 43 is attached to the debarking ring 20 using a bracket 26. The displacement mechanism 42 may comprise an actuator 44 to move the rod 43 laterally. As the rod 43 moves, the attached debarking ring 20 or 30 is moved. The actuator 44 may be embodied as an endless worm or any type of actuator, such as but not limited to mechanical, electro-mechanical, hydraulic, pneumatic and moving coil actuators. Understandably, any other type of displacement mechanism known in the art may be used within the scope of the present invention.

The displacement system 40 may further comprise sensing elements, such as switches or sensors, configured to determine the location of each debarking ring 20 or 30. The displacement system 40 may further comprise a controller configured to receive signals from the sensing elements, to send a signal or a request to the actuator 44 to be activated or deactivated. The actuator 44 may further be embodied as a servomotor adapted to precisely move one or both of the debarking rings 20 or 30.

The apparatus 100 generally comprises a frame 60. The frame 60 typically comprises horizontal supporting members 63 and vertical supporting elements 64. Broadly, the frame 60 should be adapted to support the weight of the debarking rings 20 and 30 and related equipment. The frame 60 is generally made with rigid material, such as steel. Understandably, the frame 60 may have any shape adapted to support the debarking ring 20 or 30 or adapted to fit in a predetermined environment.

One skilled in the art shall understand that the lateral position of each debarking ring 20 or 30 may be set with any method known in the art. As examples, the debarking rings 20 and 30 may be manually positioned by pushing them along the displacement system 40. In yet other embodiments, each mode of operation of the debarking rings 20 and 30 may be programmed in a controller or may be inputted by a user. In such embodiments, the displacement system 40 may comprise position sensors in communication with a controller. The controller is configured to stop movement of a debarking ring 20 or 30 when a sensor detects the presence of a debarking ring 20 or 30 and that such presence indicates a required position according to a desired mode of operation.

Referring now to FIGS. 2 to 4, different modes of operation of the apparatus 100 are shown. FIG. 2 illustrates a first debarking ring 20 in a non-operative mode, such as maintenance mode and a second debarking ring 30 in an operative mode, such as allowing flow 1 of logs to pass through the debarking ring 30. In non-operative mode, a debarking ring 20 or 30 is positioned on either side of the flow 1 of logs. To get in such an exemplary mode of operation, a first actuator 44 is activated to move the first debarking ring 20 laterally. Depending on the position of the second debarking ring 20, a second actuator 44 is activated to move laterally the second debarking ring 20 to be in line with the infeed 10 and outfeed 50 modules.

Referring now to FIG. 3, both debarking rings 20 and 30 are in non-operative mode. In such a mode of operation, the flow of logs is stopped or is carried without passing through one of the debarking rings 20 or 30. From the mode of operation shown in FIG. 2, the second actuator 44 is actuated to move laterally the second debarking ring 30 toward the left extremity of the apparatus 100.

Referring now to FIG. 4, the first debarking ring 20 is in operative mode and the second debarking ring 30 is in non-operative mode. From the mode of operation shown in FIG. 3, the first actuator 44 is actuated to move laterally the first debarking ring 20 to be in line with the infeed 10 and outfeed 50 modules.

Still referring to FIGS. 2 to 4, in some embodiments, the aperture 24 of the first debarking ring 20 may have a different diameter than the aperture 34 of the second debarking ring 30. As an example, each debarking ring 20 or 30 may have an aperture 24 or 34 adapted to expand to a diameter of 17 inches, 22 inches, 31 inched or 35 inches. In further embodiments, each debarking ring 20 or 30 may be have different embodiments, such as using different technologies. As such, the direction and/or the speed of rotation of the arms 22 or 32 of each debarking ring 20 or 30 may be different depending on predetermined operational needs. As an example, the first debarking ring 20 may be adapted to rotate clockwise and the second debarking ring 30 may be adapted to rotate counter clockwise.

In yet other embodiments, each debarking ring 20 or 30 may comprise independent controller 27 or 37 and/or one or more independent motorization modules. In some embodiments, the motorization module may comprise one or more electric motors having a frequency converter controlled by an automaton such as a PLC. The control modules 27 or 37 are configured to be in communication with the one or more motorization modules. The motorization modules are configured to convey power to displace the debarking rings 20 or 30. In further embodiments, each control module 27 or 37 may further be in communication with each another in order to synchronize operations of both debarking rings 20 and 30. Such communication may allow, as an example avoiding physical collisions between the debarking rings 20 and 30. Understandably, any type of control module and/or motorization modules known in the art or to be developed may be used within the scope of the present invention, including control module and/or motorization modules having different sizes and shapes.

In some embodiments, an interchangeable debarking rings apparatus 100 may be configured to be in communication with other interchangeable debarking rings apparatus 100. In one exemplary embodiment, a first interchangeable debarking rings apparatus 100 is positioned upstream in a line of debarking apparatus. In such embodiment, a second interchangeable debarking rings apparatus 100 is installed downstream from the first interchangeable debarking rings apparatus 100. In such an embodiment, logs are processed successively through the first and second interchangeable debarking rings apparatus 100. Understandably, in yet other embodiments, more than two interchangeable debarking rings apparatus 100 may be positioned in sequence.

In some embodiments, the interchangeable debarking rings apparatus 100 are in communication with one or more controllers or control modules. The controller is configured to control the operations of the interchangeable debarking rings apparatus 100 by sending request signals to the said interchangeable debarking rings apparatus 100. The operations may comprise moving the debarking rings 20 or 30 in operative or non-operative modes and activating or deactivating a debarking ring 20 or 30.

In a second embodiment, the log processing line may further comprise other types of stand-alone devices, such as but not limited to a flare butt reducing apparatus or any other known compatible log production line apparatus. Such stand-alone devices may be positioned upstream or downstream from the interchangeable debarking rings apparatus 100. As an example, a sawing apparatus may be positioned downstream from the debarking apparatus 100 to cut certain sections of a log being processed. In another example, a splitting apparatus may be positioned downstream from the interchangeable debarking rings apparatus 100 process. Understandably, depending on the desired output, the said stand-alone devices may be positioned upstream of the interchangeable debarking rings apparatus 100. The production line may further comprise a controller or may be configured for the different apparatus comprised in the production line to communicate with one another. Such communication generally allows the stand-alone device to dynamically adapt the mode of operation based on what is coming out form or going out to the debarking apparatus.

In a further embodiment, a method of debarking logs is presented. The method comprises the steps of receiving a log through an infeed module; moving, if not already in place, and positioning a functional debarking ring capable of processing the log's diameter in line with the output of the infeed module; adjusting the position, angle and movement of the log with the infeed module based on the position of the receiving debarking ring; debarking the log passing through the aperture of the functional debarking ring; adjusting the position of the outfeed module so that it receives the log from the output of the debarking ring and moving the log until it exits the outfeed module.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A log debarking apparatus comprising:

a frame;

a first and second debarking rings, each of the debarking rings comprising:

a frame; and an aperture adapted to receive and debark the diameter of the log;

sensing elements configured to determine position of each of the first and second debarking rings in relation to the frame of the apparatus;

wherein the first and second debarking rings are moveably mounted to the frame of the apparatus on a plane substantially perpendicular to a flow of the log to be debarked.

2. The apparatus of claim 1, wherein any one of the first and second debarking rings are moveable in an operational mode and both are moveable in a non-operational mode.

3. The apparatus of claim 1, each of the first and second debarking rings being slidably mounted to the frame of the apparatus.

4. The apparatus of claim 1, the debarking apparatus comprising an infeed module and an outfeed module.

5. The apparatus of claim 1, the apparatus comprising a displacement system, the frames of each of the first and second debarking rings being mounted to the displacement system.

6. The apparatus of claim 5, the displacement system comprising a first displacement mechanism independently moving the first debarking ring and a second displacement mechanism independently moving the second debarking ring.

7. The apparatus of claim 5, the sensing elements being connected to a controller, the controller being configured to control movement of the displacement system.

8. The apparatus of claim 7, the displacement system comprising a motorization module, the controller being in communication with the motorization module.

9. The apparatus of claim 1, the aperture of the first debarking ring having a first maximum opening diameter, the aperture of the second debarking ring having a second maximum opening diameter different than the first maximum opening diameter.

10. The apparatus of claim 1, the debarking ring apparatus in working communication with at least another apparatus in a line assembly.

11. A log debarking apparatus comprising:

a frame;

an infeed module adapted to receive a flow of logs;

an outfeed module;

a first and second debarking rings moveable in a plane substantially perpendicular to the flow of logs; and a displacement system comprising sensing elements to detect position of each of the first and second debarking rings in relation to the frame of the apparatus and adapted to move any one of the first and second debarking rings in an operative mode and any one or both of the first and second debarking rings in a non-operative mode.

12. A method for debarking logs, the method comprising:

receiving a flow of logs to be debarked through a first debarking ring comprising an aperture having a first maximum diameter;

moving the first debarking ring in a non operative position along a plane substantially perpendicular to the flow of logs;

detecting position of the first debarking ring along the plane substantially perpendicular to the flow of logs;

stopping movement of the first debarking ring based on the detected position.

13. The method of claim 12, the method comprising:

moving a second debarking ring in an operative position along the plane substantially perpendicular to the flow of logs;

detecting position of the second debarking ring along the plane substantially perpendicular to the flow of logs; and receiving the flow of logs to be debarked through the second debarking ring.

14. The method of claim 13, the method comprising moving the second debarking ring in the non-operative mode while the first debarking ring is in the non-operative mode.

15. The method of claim 13, the reception of the flow of logs to be debarked through the first debarking ring further comprising receiving the logs through a first aperture of the first debarking ring having a first maximum diameter and reception of the flow of logs to be debarked through the second debarking ring further comprising receiving the logs through a second aperture of the second debarking ring having a second maximum diameter being different than the first maximum diameter.

16. The method of claim 15, the method comprising:

detecting a diameter of the log to be debarked;

determining which of the first and second debarking rings comprise the aperture having a diameter adapted to receive the detected diameter; and if the determined debarking ring is in the non-operative mode, moving the debarking ring in the operative mode to the non-operative mode and moving the determined debarking ring in the operative mode.

* * * * *